US010670220B2

(12) United States Patent
Reinprecht et al.

(10) Patent No.: US 10,670,220 B2
(45) Date of Patent: Jun. 2, 2020

(54) METHOD FOR CONTROLLING A LASER ILLUMINATION DEVICE FOR A MOTOR VEHICLE HEADLIGHT

(71) Applicant: ZKW Group GmbH, Wieselburg (AT)

(72) Inventors: Markus Reinprecht, Pielachhauser (AT); Bettina Reisinger, Amstetten (AT); Thomas Mitterlehner, Mank (AT)

(73) Assignee: ZKW GROUP GMBH, Wieselburg (AT)

( * ) Notice: Subject to any disclaimer, the term of this patent is extended or adjusted under 35 U.S.C. 154(b) by 252 days.

(21) Appl. No.: 15/749,690

(22) PCT Filed: Jul. 20, 2016

(86) PCT No.: PCT/AT2016/060011
§ 371 (c)(1),
(2) Date: Feb. 1, 2018

(87) PCT Pub. No.: WO2017/020055
PCT Pub. Date: Feb. 9, 2017

(65) Prior Publication Data

US 2018/0224082 A1 Aug. 9, 2018

(30) Foreign Application Priority Data

Aug. 3, 2015 (AT) ..... 50699/2015

(51) Int. Cl.
*F21S 41/675* (2018.01)
*F21S 41/20* (2018.01)
(Continued)

(52) U.S. Cl.
CPC ..... *F21S 41/675* (2018.01); *F21S 41/14* (2018.01); *F21S 41/16* (2018.01); *F21S 41/24* (2018.01);
(Continued)

(58) Field of Classification Search
None
See application file for complete search history.

(56) References Cited

U.S. PATENT DOCUMENTS 9,423,091 B2 8/2016 Reinprecht et al.
9,677,736 B2 * 6/2017 Ravier ..... F21S 41/14
(Continued)

FOREIGN PATENT DOCUMENTS

EP 2537708 A2 12/2012
WO 2013/187145 A1 12/2013

OTHER PUBLICATIONS

International Search Report for PCT/AT2016/060011, dated Nov. 2, 2016 (2 pages).
(Continued)

*Primary Examiner* — Jany Richardson
(74) *Attorney, Agent, or Firm* — Eversheds Sutherland (US) LLP

(57) ABSTRACT

The invention relates to a method for controlling a laser illumination device for a motor vehicle headlight, wherein the laser illumination device comprises two or more adjustable laser light sources (11 to 18), wherein the number of laser light sources is designated as N, and each laser light source generates a laser beam (11*p* to 18*p*) and at least one optical attachment (21 to 28) is arranged downstream of each laser light source and at least one microscanner (51, 52) is assigned, and each microscanner is arranged to guide two or more laser beams onto at least one light conversion means (60), wherein on the at least one light conversion means a luminous image is produced, and an imaging system (PS) is associated with the at least one light conversion means in order to project the luminous image as a light image onto the road, wherein the method includes the following steps: dividing at least a part of the luminous image into luminous strips, wherein the number of luminous strips is designated
(Continued)

Figure 1:
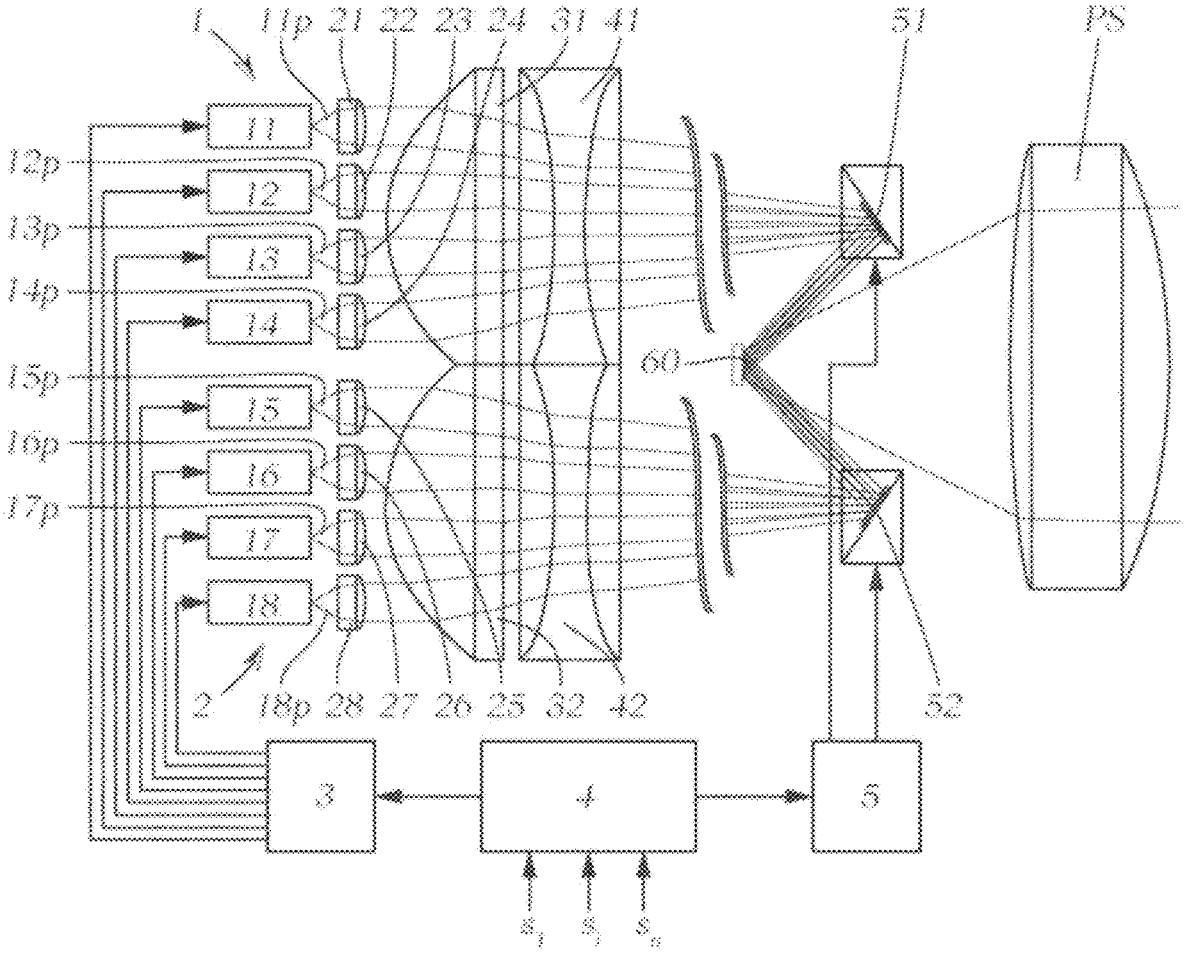

as n, determining the required luminous flux for each luminous strip, calculating a required width value for each luminous strip with regard to the required luminous flux, and using the calculated width values to change the width of the luminous strip in the light image by changing the luminous strip width on the light conversion means.

9 Claims, 6 Drawing Sheets

(51) Int. Cl.

| | |
|---|---|
| ***F21S 41/24*** | (2018.01) |
| ***F21S 41/63*** | (2018.01) |
| ***F21S 41/657*** | (2018.01) |
| ***F21S 41/16*** | (2018.01) |
| ***F21S 41/14*** | (2018.01) |
| ***F21S 41/30*** | (2018.01) |

(52) U.S. Cl.
CPC ..... *F21S 41/285* (2018.01); *F21S 41/30* (2018.01); *F21S 41/635* (2018.01); *F21S 41/657* (2018.01)

(56) References Cited

U.S. PATENT DOCUMENTS

| | | | | |
|---|---|---|---|---|
| 9,777,901 | B2 | 10/2017 | Reinprecht et al. | |
| 2014/0177250 | A1 | 6/2014 | Sheu | |
| 2015/0016134 | A1 | 1/2015 | Erdl et al. | |
| 2015/0175053 | A1* | 6/2015 | Schwaiger ..... | B60Q 1/04 315/82 |
| 2015/0176778 | A1 | 6/2015 | Schwaiger et al. | |
| 2015/0176809 | A1 | 6/2015 | Schwaiger et al. | |
| 2015/0176811 | A1 | 6/2015 | Schwaiger et al. | |
| 2015/0369440 | A1* | 12/2015 | Reinprecht ..... | F21S 41/147 362/510 |
| 2018/0224080 | A1* | 8/2018 | Reisinger ..... | F21S 41/176 |

OTHER PUBLICATIONS

Search Report issued in Austrian Application No. A 50699/2015, dated Jun. 14, 2016 (1 page).

* cited by examiner

| Light strip | $b_{0k_u}$ [°] | $b_{0k_o}$ [°] | Luminous flux [lm] |
|---|---|---|---|
| E8 | -1 | -0,625 | 32 |
| E7 | -0,625 | -0,25 | 39 |
| E6 | -0,25 | 0,125 | 38 |
| E5 | 0,125 | 0,5 | 35 |
| E4 | 0,5 | 0,875 | 28 |
| E3 | 0,875 | 1,25 | 23 |
| E2 | 1,25 | 1,625 | 15 |
| E1 | 1,625 | 2 | 7 |

| Light strip | $b'_{0k_u}$ [°] | $b'_{0k_o}$ [°] | Luminous flux [lm] |
|---|---|---|---|
| E8' | -1 | -0,6 | 34 |
| E7' | -0,6 | -0,4 | 23 |
| E6' | -0,4 | -0,2 | 22 |
| E5' | -0,2 | 0,0 | 21 |
| E4' | 0,0 | 0,3 | 29 |
| E3' | 0,3 | 0,7 | 34 |
| E2' | 0,7 | 1,1 | 27 |
| E1' | 1,1 | 2 | 27 |

METHOD FOR CONTROLLING A LASER ILLUMINATION DEVICE FOR A MOTOR VEHICLE HEADLIGHT

The invention relates to a method for controlling a laser illumination device for a motor vehicle headlight, wherein the laser illumination device comprises two or more modulable laser light sources, wherein the number of laser light sources is designated as N and each laser light source generates a laser beam, and at least one optical attachment is arranged downstream from each laser light source, and at least one microscanner is associated with each laser light source, and each microscanner is set up to guide two or more laser beams to at least one light conversion means, so that a luminous image is generated on the at least one light conversion means, and an imaging system is provided for the at least one light conversion means, in order to project the luminous image as a light image onto the road surface.

In addition, the invention relates to a laser illumination device for a motor vehicle headlight comprising two or more modulable laser light sources, wherein the number of laser light sources is designated as N, and an optical attachment is arranged downstream from each light source, and at least one microscanner is provided for each light source, and each microscanner is set up to guide the laser beam onto at least one light conversion means, so that a luminous image is generated on the at least one light conversion means, and an imaging system is provided for the at least one light conversion means in order to project the luminous image as a light image onto the road surface, and the invention also relates to a control and calculation unit.

Motor vehicle headlights with scanning laser beams by means of a light conversion means are known. They usually generate a luminous image on a light conversion means, often referred to as simply as "phosphorus," where the laser light, e.g., blue, is substantially converted to "white" light by fluorescence. The luminous image thereby created is then projected onto the road surface with the help of an imaging system, for example, a lens system, as a light image. The microscanner or the beam deflecting means is often embodied as a micromirror (or a prism), which can be moved about one or two axes, to thereby "write" a luminous image line by line, for example. Modulation of the laser light source determines the desired luminance (light intensity of the point or line) for each point or each line of the luminous image, wherein said light intensity can be adapted to the respective driving situation, on the one hand, and must conform to statutory requirements for the projected light image, on the other hand.

Use of the light scanner with one or more laser beams, which are modulated in synchronization with the oscillation of the mirror, makes it possible to generate almost any light distribution. Such a method is also known in principle with so-called pico projectors and head-up displays, which also use light scanners embodied as MEMS (micro-electro-mechanical systems). However, in contrast with such projection systems, which are often used in electronic entertainment systems, a much higher laser power must be used with headlights, in which case it is not necessary to display a colored light distribution. As mentioned above, it is customary to work with blue laser light originating from laser diodes, for example. With regard to the required high laser power on the order of 5 to 30 watts, it is important to make the best possible use of the laser power installed in a motor vehicle headlight.

Most known microscanners operate according to a resonant drive principle. The micromirrors used are excited in their resonant frequency and execute a sinusoidal oscillation. Precisely this sinusoidal curve is a major problem with regard to use of the installed laser power. Because of the sinusoidal movement of the micromirror, the optical power at the center of the image is collectively much lower than that in the boundary regions.

Such a light distribution is unwanted in particular for head-up displays and pico projectors in projection applications because all pixels there should have equal brightness. For this reason, it is known that the change in brightness due to the sinusoidal curve may be compensated by modulating the laser power in synchronization with the mirror oscillation, the laser power being reduced toward the edges to achieve a homogenous light distribution, in which each pixel is of the same brightness. The maximum brightness of the compensated image is adapted to the lowest brightness of the uncompensated image.

Because of the compensation of the brightness curve, the average laser power introduced into the system must be reduced drastically (up to 80-90%), i.e., with a laser diode having a maximum power of 1 W, only 0.1-0.2 W is utilized, and it should be pointed out that this is about the mean power, and in this example as well, the laser diode must be capable of applying an optical power of 1 W for a brief period of time. However, since the power is reduced in the boundary regions, the result is that the average power is much lower than the maximum power.

Figure 2:
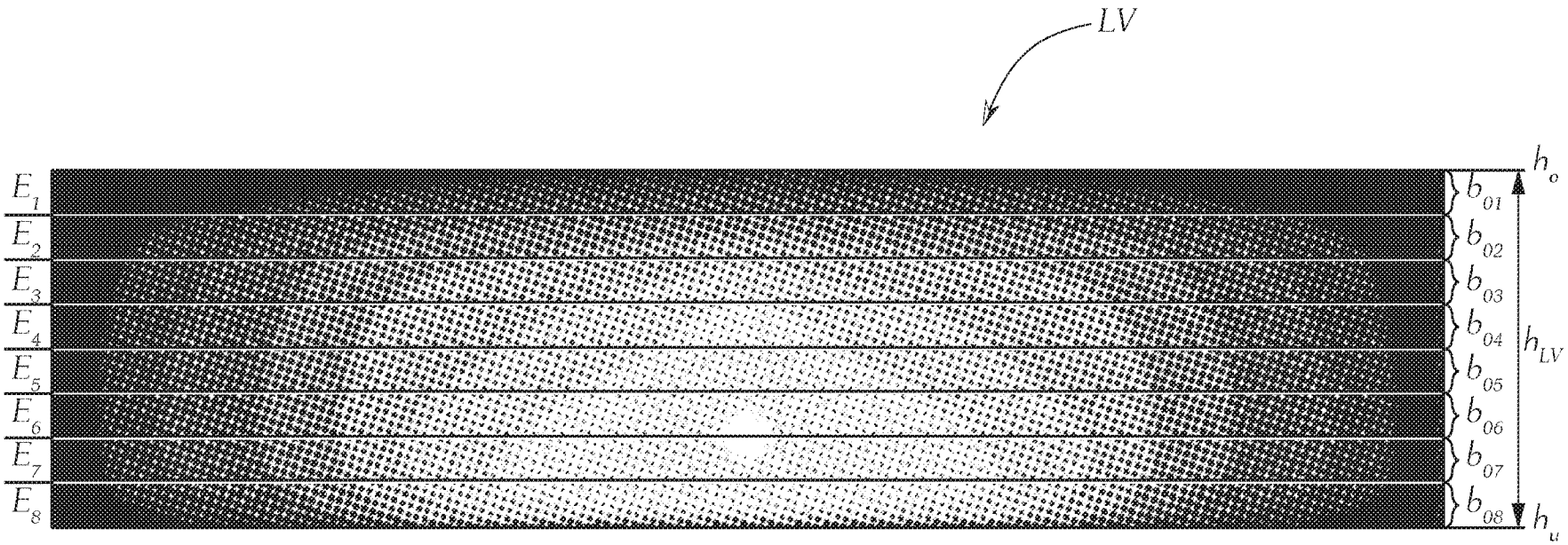

The problem presented here is further intensified in applications of the scanning method to motor vehicle headlights. Light distributions generated for the main light functions in motor vehicle headlights have the same brightness in all pixels only in the rarest cases. On the contrary, it is even desirable in the case of a light distribution in a motor vehicle for the boundary regions to be much darker than the center of the image, where a so-called light spot should usually be created. This light spot illuminates the road surface, whereas the boundary regions illuminate the surroundings around the road. For the sake of illustration, a light distribution, which is suitable as a long-range high-beam headlight distribution and is illustrated in FIG. 2, is to be considered. It can be seen here that a high light power (100%) is required at the center of the image, whereas there is already a definite decline in brightness in the boundary regions. If the laser power of a sinusoidal micromirror oscillating in two directions is compensated in this case, then it can be shown that only approximately 10% to 20% of the installed laser power is utilized.

One possibility of at least partially combatting the aforementioned problem is to use luminous strips of different widths (a luminous strip is naturally formed on the light conversion means when the light of a laser light source (laser diode) is deflected onto the conversion means by 1D microscanners). In the document AT 513916 A2 by the present applicant, luminous strips of different widths were used to increase the vertical resolution in the light image. However, this document does not describe a change in the luminous strip width and therefore an adaptation of the width of the luminous strips with respect to the laser power.

One object of the present invention is to create a method as well as a laser illumination device, which operates according to such a method for motor vehicle headlights, in which an improved utilization of the installed laser power is possible with the least possible effort for control of optically relevant components in particular.

This object is achieved with a method of the type defined in the introduction, in which at least a portion of the luminous image is divided into luminous strips according to the invention, wherein the number of luminous strips is designated as n, the desired luminous flux per luminous strip is determined, the desired strip width per luminous strip is calculated with regard to the desired luminous flux, and the calculated width values are used to adjust the width of the light strip in the light image by modifying the luminous strip width in the light conversion means.

With regard to the number of laser light sources, it may be advantageous if the change in the luminous strip width is accomplished by beam splitting of each laser beam by means of the at least one optical attachment, preferably a semi-transparent mirror or a fiber-optic beam splitter.

With regard to the change in the laser illumination device from the standpoint of design technology, it may be expedient if the change in the width of the luminous strip is accomplished by beam focusing, i.e., by focusing or defocusing each laser beam by means of the at least one optical attachment, preferably a lens system.

In addition, it may be advantageous if the beam focusing is accomplished by means of a change in position of the at least one optical attachment, preferably a lens system and/or the at least one light conversion means.

In a variant that has proven successful in practice, it is provided that the desired luminous flux per light strip is determined according to the formula $E_m=E_{tot}/n$ where $E_{tot}$ is the total current.

It may be also be advantageous if the calculation the desired width value per light strip with regard to the desired luminous flux also includes the following:

step s50: selecting a light strip;

step s51: determining an actual luminous flux for this selected light strip;

step s52: determining the actual width value; and step s53: adjusting the width value until the actual luminous flux is essentially equal to the desired luminous flux.

In addition, it may be advantageous if the calculation of the desired width value per light strip includes the following with regard to the desired luminous flux:

step s60: selecting a light strip;

step s61: determining an actual width value;

step s62: determining an actual luminous flux for the selected light strip;

step s63: comparing the actual luminous flux with the desired luminous flux;

step s64: increasing or decreasing or retaining the actual width value, depending on whether the actual luminous flux is less than the desired luminous flux, or the actual luminous flux is greater than the desired luminous flux, or the actual luminous flux is substantially the same as the desired luminous flux; and step s65: repeating steps s62, s63 and s64 with the adjusting width values until the actual luminous flux is essentially the same as the desired luminous flux.

The object of the invention is thus also achieved with a laser illumination device of the type defined in the introduction, with which the control and computation unit is equipped to carry out the method according to any one or more of claims 1 through 7, which were specified above.

Figure 3:
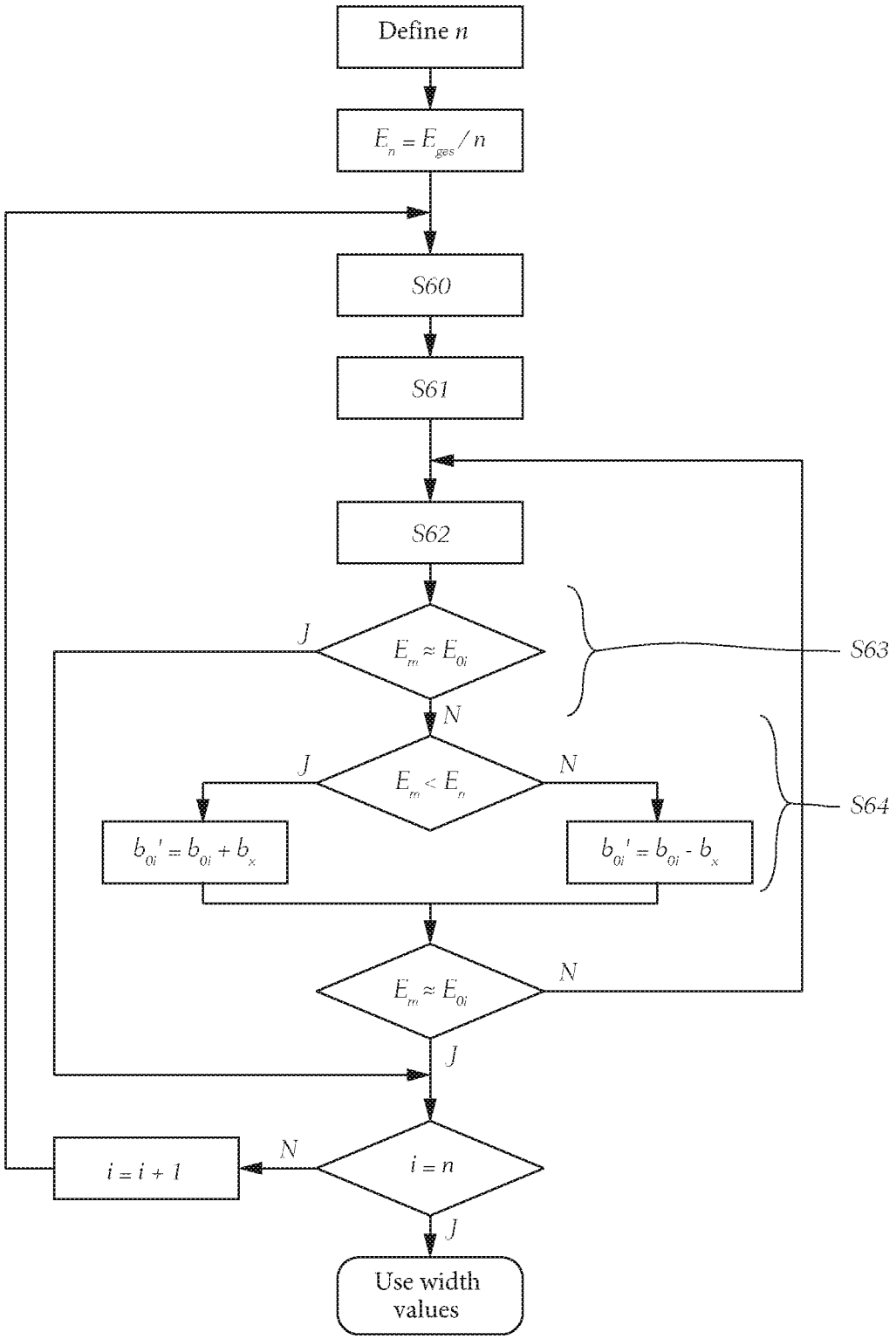
Figures 4, 5A, 5B:
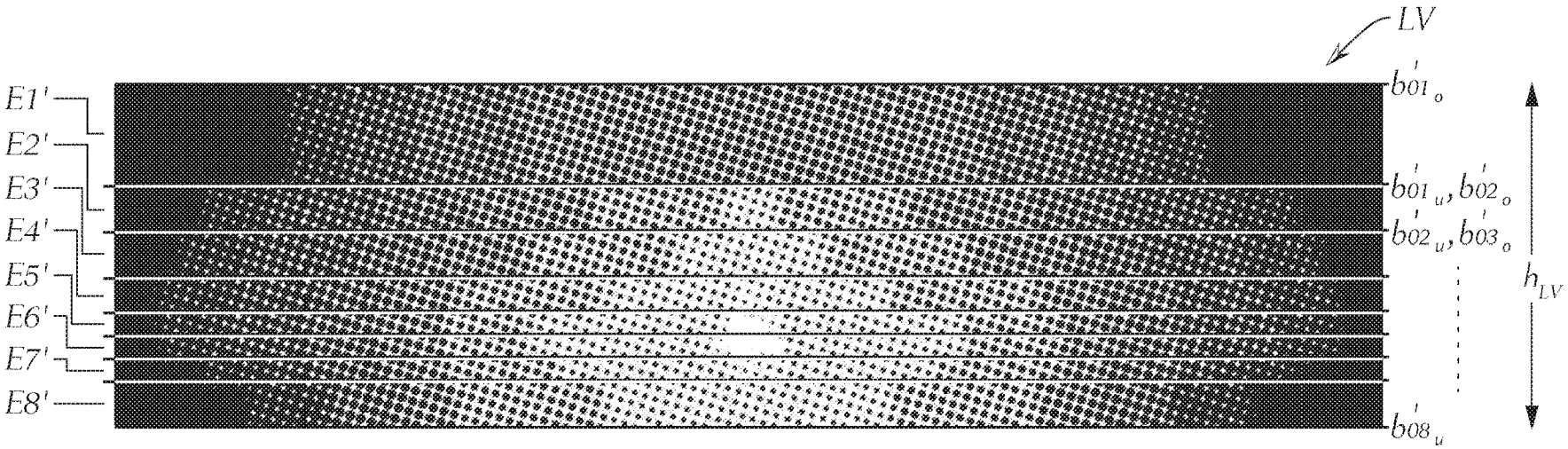
Figure 6A:
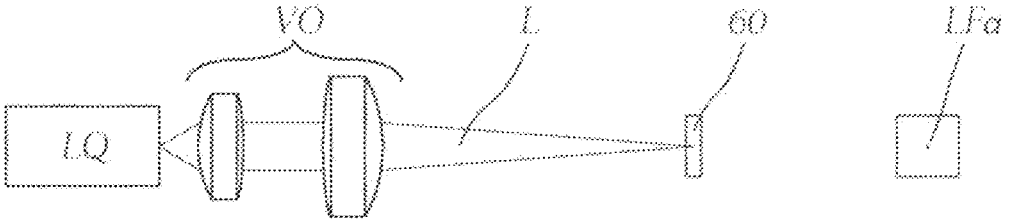
Figure 6B:
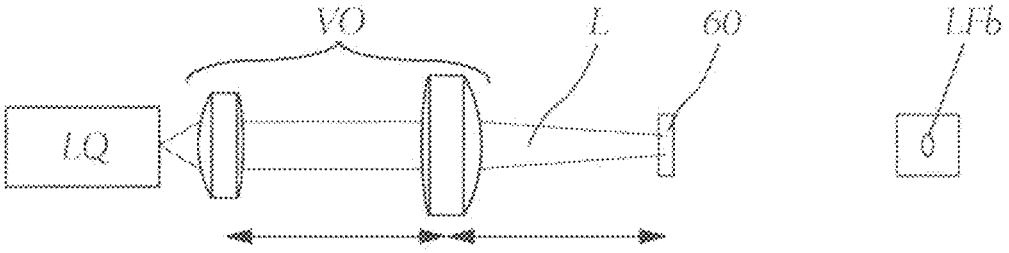
Figure 6C:
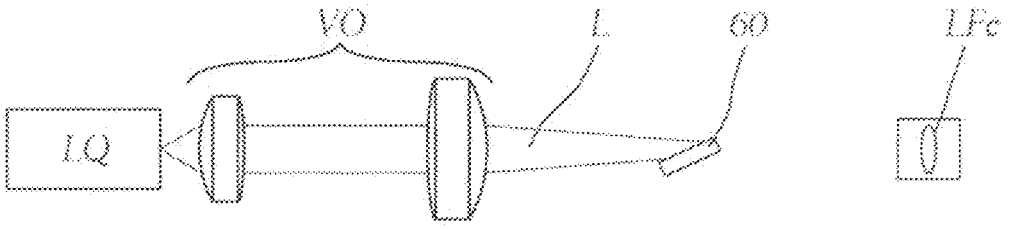
Figure 6D:
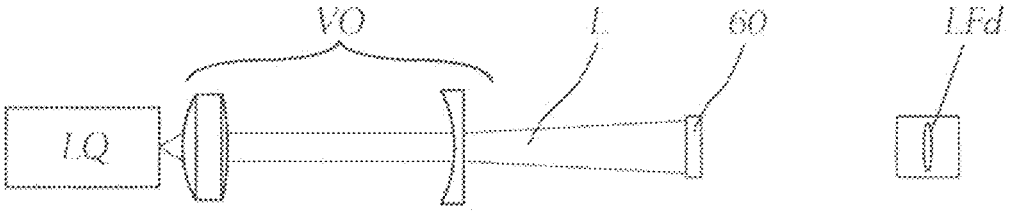
Figure 6E:
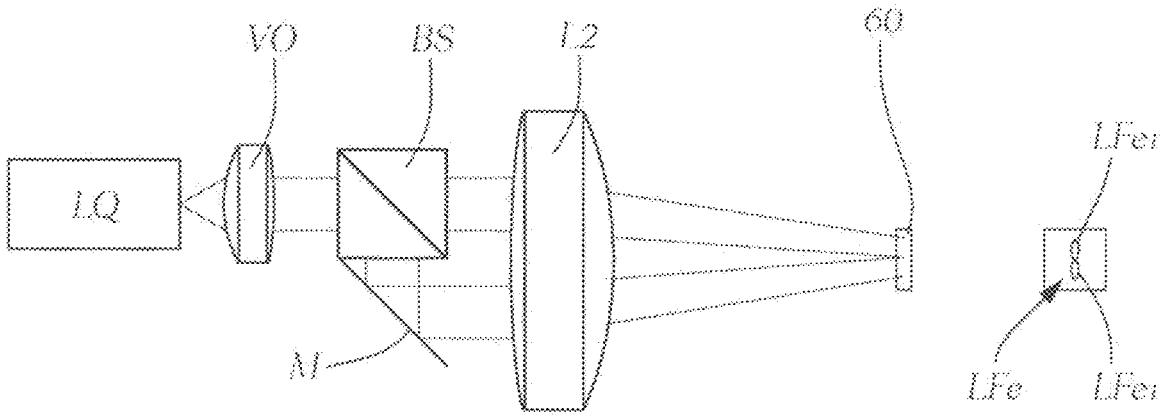

The invention is explained in greater detail below, together additional advantages, on the basis of exemplary embodiments illustrated in the drawings, in which:

FIG. 1 shows the components of a laser illumination device of a traditional device that are essential for the invention as well as their relationship in a schematic diagram, FIG. 2 shows a division of the light image created with the laser illumination device according to FIG. 1 into light strips according to the prior art, FIG. 3 shows a flow chart of one variant of a method according to the invention, FIG. 4 shows an adjusted division of the light image according to the adjusted light width values from the method according to FIG. 3, FIG. 5*a* shows positions of the light strip boundaries and luminous flux values from FIG. 2, FIG. 5*b* shows positions of the light strip boundaries and luminous flux values from FIG. 4, FIG. 6*a* shows an optical attached according to the prior art, FIG. 6*b* shows a displaceable optical attachment, FIG. 6*e* shows a pivotable light conversion means, and FIG. 6*d* shows a scattering lens as part of the optical attachment.

Figure 6F:
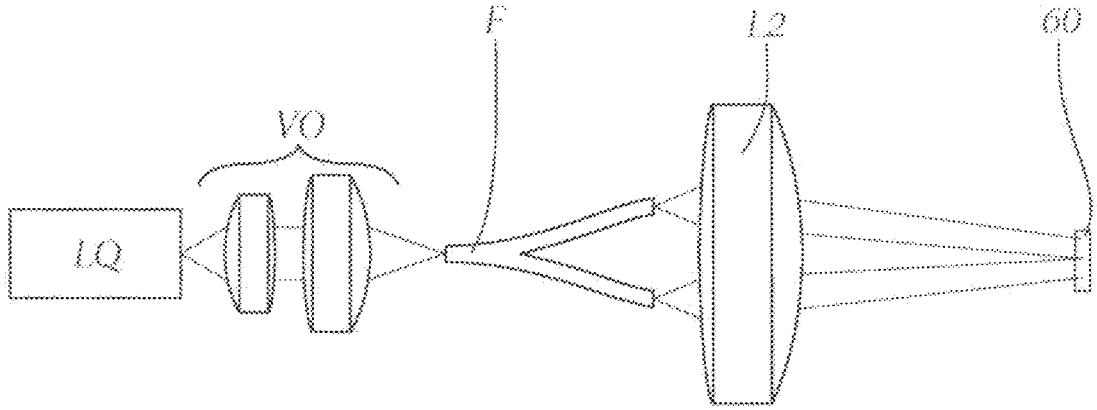

FIGS. 6*e* and 6*f* show technical means for adjusting the luminous strip width by beam splitting with the conversion means.

Reference is made first to FIG. 1, which shows as laser illumination device known in the prior art (see AT 514834 A2, for example), which serves as the starting point for a method according to the invention and a laser illumination device according to the invention.

The starting point for the laser illumination device shown here from the standpoint of light technology is two groups, in this case groups 1 and 2 situated one above the other, each having four laser light sources 11, 12, 13, 14 and/or 15, 16, 17, 18, each of which can emit a laser beam designed at 11*p* through 18*p*. A laser controller 3 is assigned to the laser light sources 11 through 18, this controller 3 serving to supply the electric power and also being equipped to modulate the beam intensity of the individual lasers. The term "modulation" in conjunction with the present invention is understood to mean that the intensity of a laser light source can be adjusted, whether continuously or pulsed in the sense of turning it on and off. It is important that the luminous power can be adjusted dynamically by a similar method, depending on the location, in which the beams are deflected. In addition, there is also the possibility of turning them on and off for a certain period of time in order not to illuminate defined locations.

The laser controller 3 in turn contains signals from a central headlight controller 4, which can receive sensor signals s1 . . . si . . . sn. These control and sensor signals may in turn be switching commands for switching from high beam to low beam on the one hand or on the other hand signals received from light sensors or cameras, which detect the illumination conditions in the surroundings of the vehicle and can mask out or diminish certain regions in the light image, for example. The laser light sources 11 through 18, which are preferably embodied as laser diodes, may emit blue light or UV light, for example.

Each laser light source 11 through 18 has a separate downstream collimator lens 21 through 28, which bundles the laser beam 11*p* through 18*p*, which is initially highly divergent. Next, the distance between the laser beams of the first group 1 and/or the second group 2 is reduced by a common collective lens 31 and/or 32 and the exit angle of the laser beams is kept as small as possible with downstream scattering lenses 41 and/or 42.

The four laser beams 11*p*, 12*p*, 13*p* and 14*p* of the first group 1 that have been "bundled" in the manner described here strike a first microscanner 51 and the laser beams 15*p*, 16*p*, 16*p* [sic] and 18*p* of the second group 2 strike a second microscanner 52 similarly, and the two laser beams are reflected jointly onto a light conversion means 60 embodied as a luminous surface in the present case. The term "microscanner" here is understood to be a general beam deflecting means capable of pivoting about one or two spatial axes, usually embodied as a micromirror but need not necessarily be embodied as such but instead may also be a prism, for example. The light conversion means 60 has phosphorus [luminescent substance] for light conversion in a known way, converting blue light or UV light into "white" light, for example. The term "phosphorus" is understood here in conjunction with the present invention to refer in very general terms to a substance or a substance mixture that converts light of one wavelength into light of another wavelength or a mixture of wavelengths, in particular into "white" light, which can be subsumed under the term "wavelength conversion", "white light" is understood to refer to light of a spectral composition, which imparts to a person the color impression of "white." The term "light" is of course not limited to radiation visible to the human eye. Optical ceramics, which are transparent ceramics such as YAG-Ce (yttrium-aluminum garnet doped with cerium), for example, may also be used.

The microscanner 51 is controlled by a microscanner controller 5 and is induced to oscillation at a constant or variable frequency, wherein these oscillations may correspond in particular to the natural mechanical frequency of the microscanner. The microscanner controller 5 is in turn controlled by the headlight controller 4 to be able to adjust the amplitude of oscillation of the microscanners 51, 52, wherein asymmetrical oscillation about the axis can also be set. The control of microscanners is known and may be accomplished in a variety of way, for example, electromagnetic, electrostatic, thermoelectric and piezoelectric [methods]. In tested specific embodiments of the invention, the microscanners 51, 52 oscillate at a frequency of a few hundred Hz, for example, and their maximum deflection amounts to a few degrees, up to 60°, depending on their controller. The position of the microscanners 51, 52 is expediently reported back to the microscanner controller 5 and/or to the headlight controller 4. The two microscanners may oscillate in synchronization, but asynchronous oscillation can also be used, for example, to make the thermal burden on the luminous surface and/or the light conversion means more uniform.

Although this illumination device has microscanners, which oscillate about only one axis, it is also possible to use microscanners that oscillate about two axes. In this case, multiple laser beams may be directed at such a microscanner, then generating directly adjacent or overlapping light strips. Embodiments with just one single microscanner are also conceivable, in which case the laser beams will strike the microscanner directly in the direction opposite the main beam direction of the headlight, for example, and the microscanner then deflects the laser beams onto illuminated phosphorus.

Specific embodiments having different numbers of laser light sources and lenses downstream from the laser light sources and the respective microscanners are possible in general. In addition to the embodiment described above, in which one microscanner is assigned to several laser sources, it is also quite possible for exactly one microscanner, for example, to be assigned to each laser light source, so that only the laser beam generated by this laser light source is deflected by this microscanner. Alternatively, it is conceivable for one of the lenses downstream from the one laser light source to be embodied as a beam splitter, in which case two or more microscanners are assigned to a single laser light source. In this case, the laser light sources, the lenses and the microscanners may be grouped and arranged in various ways relative to one another, depending on the available installation space or the heat dissipation requirements. However, by dividing the laser light sources into two groups and using two microscanners, certain advantages are achieved with regard to a compact design and heat dissipation that can be controlled well, especially since the possible thermal load of a microscanner is limited.

FIG. 2 shows a light image created on the road surface by means of the laser illumination device from FIG. 1, which is designed as an additional high beam distribution LV having a height $h_{LV}$, and this illustrates the object of optimum utilization of the power of laser light sources 11 through 18, as formulated in the introduction. The term "road surface" is used here for a simplified diagram because, whether the light image is actually on the road surface or extends beyond it will of course depend on local conditions. For example, to test the emitted light distributions, a projection of the light image onto a vertical surface is created in accordance with the relevant standards (onto a measurement screen which is set up at a distance from the respective motor vehicle illumination device in accordance with statutory requirements), which are based on the motor vehicle illumination technique. The light image LV is divided into eight light strips E1 through E8 of the same size, i.e., the same width and same length, running horizontally, having widths b01 through b08. It should be noted here that the total of the light strip widths b01 to b08 always yields the height of the light distribution $h_{LV}$, where the height $h_{LV}$ complies with the standards established by law. The number of light strips corresponds to the number of laser light source 11 to 18, wherein each light strip is created by a respective light source: E1 by 11, E2 by 12 up to E8 by 18. To generate a light image that conforms to the statute, each light strip must have the specified values for the illumination intensity. To obtain these values, light strips of a corresponding light intensity must be achieved by the light conversion means 60. In the case illustrated here, the stipulated values for the illumination intensity are achieved by modulating the laser light sources. For example, the laser light source 17 is operated at essentially maximum power for the light strip E7, which appears to be "the brightest," whereas a much lower light intensity is required by the first luminous strip, which appears as the "darkest" light strip E1 in the light image (this is also illustrated in the right column in FIG. 5*a*). Consequently, less laser power is also required by the laser light source 11. The fact of whether a light strip appears "bright" or "dark" can be expressed physically by the luminous flux flowing through the corresponding light strip. For example, the right column in the table in FIG. 5*a* shows that the luminous flux flowing through the surface area of the light strip E7 is much higher than the luminous flux flowing through the surface area of the light strip E1.

The division of the light image, which is already mentioned above in conjunction with FIG. 2, into light strips (or, equivalently, division of the luminous image into luminous strips) is the first step in the preferred exemplary embodiment of the method according to the invention. Since the relevant measurements are performed on the light distribution, i.e., on the light image, the following discussion will refer to light strips and luminous fluxes per light strip (measured in lumen).

Alternatively, it is conceivable for the light intensity per luminous strip to be measured (in candelas) in a predetermined direction directly on the conversion means 60. The size of the starting point for the method according to the invention is selected by those skilled in the art, depending on the available measurement data per se.

As already mentioned above, the number of light strips n corresponds to the number of laser diodes N used, wherein for the sake of simplicity it is assumed that each laser light source has the same maximum power. However, this assumption does not constitute a restriction so that the method according to the invention can be used readily for laser light sources with a different maximum power.

The desired luminous flux per light strip (light intensity per luminous strip) is defined in another step. The flow chart in FIG. 3 illustrates this step plus additional method steps in one exemplary embodiment. In the flow chart in FIG. 3, the desired luminous flux $E_m$ per light strip is determined according to equation $E_m=E_{tot}/n$, where $E_{tot}$ is the luminous flux for the total light image (total luminous flux), so that the desired luminous flux having essentially an equal distribution over the light strips is obtained. However, it is also quite conceivable to calculate the desired luminous flux per light strip by another method, which is accessible and self-evident to those skilled in the art, and to thereby obtain a different distribution of the desired luminous flux over the light strips.

In the next step, the desired width values of the light strips are calculated on the basis of the total luminous flux $E_{tot}$, the number of light strips n, the height of the light distribution $h_{LV}$ and the desired luminous flux $E_m$ per light strip. This may take place in one or more steps, wherein a light strip LB is first selected in the exemplary embodiment illustrated in FIG. 3 (step s60), and its actual width value $b_{0i}$ is determined (step s61). Then (step s62) the luminous flux $E_{0i}$ flowing through this light strip $LB_i$ is determined. In the next step s63, the actual luminous flux $E_{0i}$ is compared with the desired luminous flux $E_m$. If the actual luminous flux $E_{0i}$ and the desired luminous flux $E_m$ are substantially the same, then the next light strip is selected easily. However, if the actual luminous flux $E_{0i}$ is less than or greater than the desired luminous flux $E_m$, then the width value $b_{0i}$ and that of the light strip $LB_i$ are increased or decreased, respectively, by a predetermined value $b_x$—step s64. The luminous flux through this light strip is also changed by changing the width of the selected light strip $LB_i$ to a new value $b'_{0i}=b_{0i}+bx$ and/or $b'_{0i}=b_{0i}-b_x$. The steps s62 through s64 are repeated until the adjusted value of the luminous flux $E'_{0i}$ for the selected light strip is substantially the same as the desired luminous flux $E_m$. The next light strip is then selected.

In this exemplary embodiment, the light strips are provided with a running index i. In the next step the running index is compared with the number of the light strips n. If this value is the same as the number of light strips n, this means that the width values of all the light strips have already been adjusted, and the adjusted luminous flux through each light strip is essentially equal to the desired luminous flux. If this value does not correspond to the number of light strips n, then the running index i is incremented by one.

It should be pointed out in particular here that the change in the light strip widths $b_{01}$ to $b_{08}$ takes place under one condition: the total of the desired light strip widths $b'_{01}$ to $b'_{08}$ must be essentially equivalent to the height of the emitted light distribution $h_{LV}$. It follows from this that the type of light distribution is not altered by the optimization. Although the preferred embodiment involves a change in the light strip widths with an auxiliary long-range high-beam light distribution, the method can readily be used for a change in the light strip widths with other types of light distributions, for example, low-beam headlight, high-beam headlight, bad weather light, turn light and other light distributions that conform to the law. This method is suitable in particular for presetting the laser light illumination device, i.e., the width values of the light strips generated by the laser light illumination device are adjusted with the help of the method according to the invention before starting operation of the laser light illumination device and are not changed further during operation. However, this does not preclude use of this method with so-called dynamic light distributions.

FIG. 4 illustrates the division of the auxiliary long-range high-beam headlight distribution LV into light strips $E'_1$ to $E'_8$ with the adjusted light strip width $b'_{01}$ to $b'_{08}$, as described above, where the upper and lower limits of each light strip are located at $b'_{01o}$ to $b'_{08o}$ and/or at $b'_{01u}$, to $b'_{08u}$. The total of the light strip widths $b'_{01}$ to $b'_{08}$ is equal to the height $h_{LV}$ of the auxiliary long-range light distribution LV.

The differences between the original luminous flux values per light strip and those achieved by means of the method according to the invention are illustrated in the tables in FIGS. 5*a* and 5*b*, where the original light strip width is 0.375° per light strip, wherein the luminous flux values are scattered between 7 and 39 lumens (lm) per light strip (FIG. 5*a*). In the case of the light strips with an altered (optimized) width, the scattering in the luminous flux values is much smaller, amounting to max. 13 lm (FIG. 5*b*).

Although the light strips considered in this embodiment are aligned horizontally, this method may also be used with a light image divided into horizontal and/or vertical light strips.

In conclusion, FIGS. 6*a* to 6*f* illustrate schematically the technical means for altering the luminous strip width with the conversion means 60. For the sake of simplicity of the diagram, only one laser light source LQ with its upstream optical attachment VO and the conversion means 60 will be considered here. There is no structure having a microscanner, so that the laser light beam L strikes the conversion means 60 downstream from the optical attachment VO and generates a luminous spot of $LF_a$ to $LF_f$. FIGS. 6*a* to 6*b* illustrate thematically the principle of beam focusing and/or defocusing, i.e., a shift in the focal point of the optical attachment with respect to the conversion means. FIGS. 6*e* and 6*f* illustrate another technical means for adjusting the luminous strip width by beam splitting with the conversion means 60.

In conjunction with the present invention, the term "optical attachment" is understood to refer to an arrangement of optically relevant elements. In the simplest case, this arrangement may comprise one, two or more lenses (FIGS. 6*a* to 6*d*) and may be equipped for beam focusing and/or beam collimation. In addition, this arrangement may comprise additional beam splitters, which are embodied, for example, as semi-transparent mirrors or fiber-optic beam splitters and/or mirrors (FIGS. 6*e* and 6*f*).

FIG. 6*a* shows the laser beam focused on the light conversion means 60 generating a very small luminous spot $LF_a$. If an oscillating microscanner is placed between the optical attachment VO and the conversion means 60, the result is a luminous curve on the conversion means. FIG. 6*b* shows technical means for an embodiment of the device according to the invention, with which the size of the luminous spot $LF_b$ and consequently the luminous strip width can be varied through the movement of the optical attachment VO. In doing so, the laser light beam L is defocused by a parallel shift in the optical attachment VO along the light propagation direction. FIG. 6*c* shows another embodiment of the device in which the conversion means 60 can be pivoted about at least one axis and the size of the luminous spot $LF_c$ generated by the laser beam L can be varied by pivoting. FIG. 6*d* illustrates yet another embodiment, in which a diffusion lens is used in the optical attachment VO, thereby defocusing the laser beam L. The size of the luminous spot $LF_d$ is therefore in turn altered.

FIGS. 6*e* and 6*f* show two other possibilities for varying the luminous strip width based on the principle of beam splitting. FIG. 6*e* shows a laser light source LQ and an optical attachment VO as an arrangement of two lenses L1 and L2, an additional 50/50 beam splitter BS (50/50 refers to the splitting of the intensity of the transmitted light and of the reflected light) and an additional mirror M. This embodiment is especially advantageous when the number of laser light sources used at a suboptimal power is to be reduced. In doing so, two luminous strips are generated with a single laser light source LQ, with only 50% of the power of the laser light source being consumed per luminous strip $LF_{e1}$, $LF_{e2}$. The width of the resulting total luminous strip $LF_e$ is twice as great as the width of a luminous strip without the 50/50 beam splitter BS and the mirror M. It should be pointed out here that the lens L2 is merely a schematic representation and need not be designed in one piece. In general, the lens L2 can be replaced by another arrangement of lenses to further modify the width of the luminous strips $LF_{e1}$, $LF_{e2}$. Furthermore, it should also be pointed out here that this embodiment is not restricted to the use of a 50/50 beam splitter BS and a mirror M. Arrangements of several beam splitters and mirrors may also be used, in which case each beam splitter in such an arrangement may have a transmission coefficient and/or reflection coefficient that is different from that of the 50/50 beam splitter (for example, a reflection coefficient ⅓, ¼, ⅕, ⅙ or ⅛).

In addition, FIG. 6*f* shows an embodiment, in which the beam splitting is accomplished with the help of an optical fiber beam splitter F, wherein the intensity of the laser beam emitted by the laser light surface LO is distributed over two laser beams emerging from the optical fiber beam splitter F. As in the example illustrated in FIG. 6*e*, here again, the intensity distribution need not be the same over two beams. Furthermore, here again, the beam splitting into two emerging laser beams is not restrictive. Several emerging laser beams (3, 4, 5 or even more) can be generated with different intensities of the emitted laser beam. The lens system L2 is in turn a schematic representation of a general arrangement of lenses. The same comments apply to the lens system L2 in FIG. 6*f* as those made with regard to the lens system L2 in FIG. 6*e*.

In conclusion it should be pointed out that the technical means illustrated in FIGS. 6*a* to 6*f* do not preclude one another but instead can definitely be combined. For example, it may be advantageous for reasons associated with the construction technology to create a laser illumination device comprising semi-transparent mirrors, optical fiber beam splitters and lens systems at the same time, wherein at least a portion of said means may be movable.

The invention claimed is:

1. A method for controlling a laser illumination device for a motor vehicle headlight, wherein the laser illumination device comprises two or more modulable laser light sources (11 to 18), wherein a number of laser light sources is designated as N and each laser light source generates a laser beam (11*p* to 18*p*), wherein at least one optical attachment (21 to 28) is arranged downstream from each laser light source, wherein at least one microscanner (51, 52) is assigned to each laser light source, wherein each microscanner is configured to guide two or more laser beams to at least one light conversion means (60) so that a luminous image is generated on the at least one light conversion means, and wherein an imaging system (PS) is assigned to the at least one light conversion means to replicate the luminous image as a light image on a road surface, the method comprising the following steps performed by a headlight controller (4):

dividing the luminous image into luminous strips, wherein a number of luminous strips is designated as n;

determining a desired luminous flux per luminous strip;

calculating, based on the desired luminous flux, a desired width value per luminous strip; and adjusting, based on the desired width values, a width of a light strip of the luminous strips in the light image by varying a luminous strip width on the light conversion means.

2. The method according to claim 1, wherein a change in the luminous strip width takes place through beam splitting of each laser beam by the at least one optical attachment.

3. The method of claim 2, wherein the at least one optical attachment comprises a semi-transparent mirror (BS) or an optical fiber beam splitter (F).

4. The method according to claim 1, wherein a change in the luminous strip width is accomplished by beam focusing of each laser beam by the at least one optical attachment.

5. The method according to claim 4, wherein the beam focusing is accomplished by a change in position of the at least one optical attachment and/or the at least one light conversion means (60).

6. The method of claim 4, wherein the at least one optical attachment comprises a lens system (VO).

7. The method according to claim 1, wherein the desired luminous flux ($E_m$) per light strip is determined according to an equation comprising $E_m=E_{tot}/n$, where $E_{tot}$ is a total flux.

8. The method according to claim 1, wherein the calculation of the desired width value per light strip comprises the following with respect to the desired luminous flux ($E_m$):

(s50) selecting a light strip ($LB_i$), (s51) determining an actual luminous flux ($E_{0i}$) for the selected light strip ($LB_i$), (s52) determining an actual width value ($b_{0i}$), and (s53) changing the actual width value ($b_{0i}$) until the actual luminous flux ($E_{0i}$) of the desired luminous flux ($E_m$) is essentially equal.

9. The method according to claim 1, wherein the calculation of the desired width value per light strip comprises the following with respect to the desired luminous flux ($E_m$):

(s60) selecting a light strip ($LB_i$), (s61) determining an actual width value ($b_{0i}$), (s62) determining an actual luminous flux ($E_{0i}$) for the selected light strip ($LB_i$), (s63) comparing the actual luminous flux ($E_{0i}$) with the desired luminous flux ($E_m$), (s64) increasing or decreasing or retaining the actual width value ($b_{0i}$) depending on whether the actual luminous flux ($E_{0i}$) is less than the desired luminous flux ($E_m$) or the actual luminous flux ($E_{0i}$) is greater than the desired luminous flux ($E_m$) or the actual luminous flux ($E_{0i}$) is essentially equal to the desired luminous flux ($E_m$), and (s65) repeating steps (s62), (s63) and (s64) using the adjusted width values until the actual luminous flux ($E_{0i}$) is essentially equal to desired luminous flux ($E_m$).

* * * * *